United States Patent [19]

Masubuchi

[11] 4,422,263

[45] Dec. 27, 1983

[54] GEAR CHANGING MECHANISM FOR TOY VEHICLE DRIVING DEVICES

[75] Inventor: Hiroshi Masubuchi, Utsunomiya, Japan

[73] Assignee: Tonka Corporation, Hopkins, Minn.

[21] Appl. No.: 942,428

[22] Filed: Sep. 14, 1978

[30] Foreign Application Priority Data

Oct. 14, 1977 [JP] Japan ..... 52-138565

[51] Int. Cl.[3] ..... A63H 29/20; F03G 3/08; F16H 35/00

[52] U.S. Cl. ..... 46/209; 74/384; 74/572

[58] Field of Search ..... 74/329, 325, 331, 61, 74/384, 572; 46/206, 209, 202, 208

[56] References Cited

U.S. PATENT DOCUMENTS

| | | | |
|---|---|---|---|
| 806,977 | 12/1905 | Kingsbury | 46/209 |
| 3,546,809 | 12/1970 | Nielsen | 46/206 |
| 3,798,831 | 3/1974 | Higashi | 46/206 |
| 3,812,933 | 5/1974 | Darda | 46/206 |
| 4,059,918 | 11/1977 | Matsushiro | 46/209 |
| 4,116,084 | 9/1978 | Masuda | 46/209 |
| 4,130,963 | 12/1978 | Ohashi | 46/209 |
| 4,141,256 | 2/1979 | Wilson et al. | 46/209 X |

FOREIGN PATENT DOCUMENTS

| | | | |
|---|---|---|---|
| 563929 | 9/1958 | Canada | 46/209 |
| 913510 | 6/1954 | Fed. Rep. of Germany | 46/209 |
| 791118 | 12/1935 | France | 46/208 |
| 1394867 | 3/1965 | France | 46/206 |
| 487524 | 6/1938 | United Kingdom | 46/208 |

*Primary Examiner*—Allan D. Herrmann

*Attorney, Agent, or Firm*—Merchant, Gould, Smith, Edell, Welter & Schmidt

[57] ABSTRACT

A toy vehicle is disclosed including a gear changing mechanism for use in conjunction with a flywheel driving device. The mechanism comprises a gear changing lever pivotally mounted to a frame by means of a pin. The lever is biased in one direction by means of a first spring member to hold the axle of an idle gear in engagement with one end of an elongated opening formed in the frame. The gear changing lever is adapted to pivot by a depressing action against the force of the first spring member to disengage the idle gear axle from the one end of the elongated opening so as to allow a second spring member to urge the idle gear axle against the other end of the elongated opening.

8 Claims, 3 Drawing Figures

GEAR CHANGING MECHANISM FOR TOY VEHICLE DRIVING DEVICES

BACKGROUND OF THE INVENTION

The present invention relates to a built-in power source or flywheel driving device for use in toy vehicles such as trains and cars and, more particularly, to a gear changing mechanism for use in such a driving device.

The present invention provides a gear changing mechanism in which gear changing can be effected simply by depressing a lever.

IN THE DRAWINGS

DETAILED DESCRIPTION OF THE PRESENT INVENTION

Figure 1:
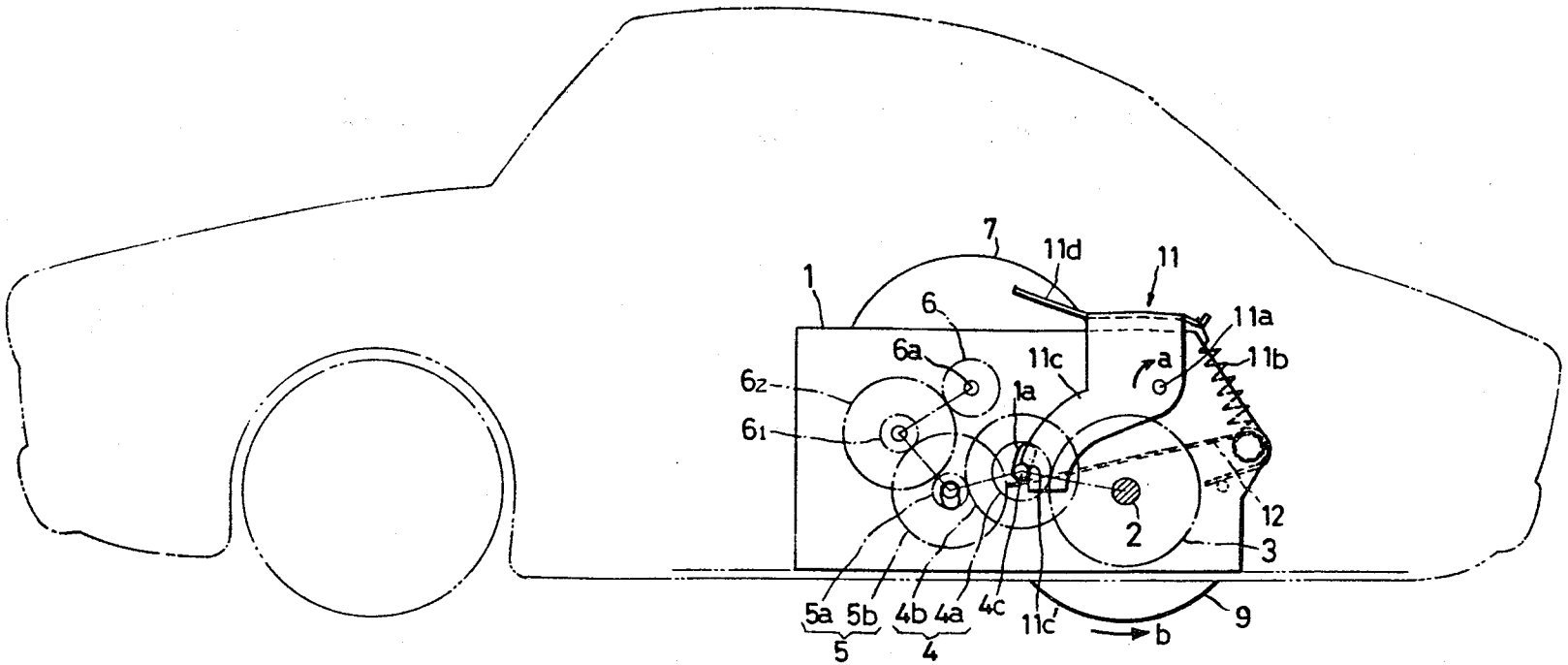
FIG. 1 is a side view showing the present invention before the gear changing lever is depressed.
Figure 2:
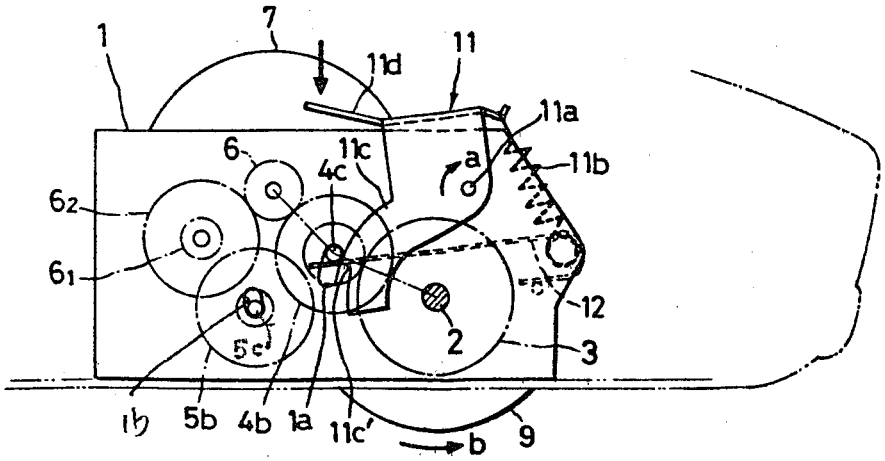
FIG. 2 is a side view after the gear changing lever is depressed.
Figure 3:
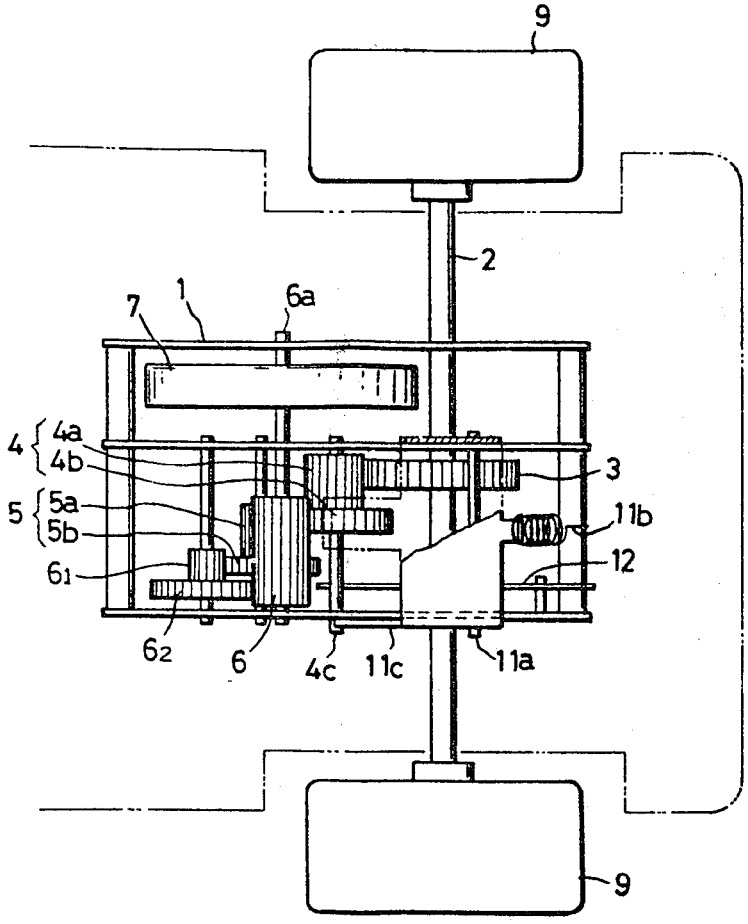
FIG. 3 is a plan view of the present invention.

One embodiment of a gear changing mechanism made in accordance with the present invention will now be described in detail with reference to the accompanying drawings. The built-in flywheel driving device is first described. The gear changing mechanism of the present invention is then described. In the figures, the reference numeral 1 designates the frame of the driving device or power source. An axle 2 is rotatably mounted in the frame 1. The axle 2 has wheels 9 on its opposite ends. A toothed wheel 3 is secured on the axle 2. A first idler gear 4 is secured on its axle 4*c*. The axle 4*c* is supported in elongated holes 1*a* formed in the frame 1. The first idler gear 4 includes small and large diameter toothed wheels 4*a* and 4*b*. The small diameter toothed wheel 4*a* is held in mesh with the toothed wheel 3. A second idler gear 5 is secured on its axle 5*c* which is received in elongated holes 1*b* formed in the frame 1. The second idler gear 5 includes small and large diameter toothed wheels 5*a* and 5*b*. The small diameter toothed wheel 5*a* meshes with the large diameter toothed wheel 4*b* of the first idler gear 4 when the axle 4*c* of the first idler gear 4 is held in engagement with the lower end of the elongated hole 1*a* and comes out of mesh with the large diameter toothed wheel 4*b* when the axle 4*c* of the first idler gear 4 is urged against the upper end (the other end) of the elongated hole 1*a*. A gear 6 is drivingly connected through toothed wheels $6_1$ and $6_2$ to the large diameter toothed wheel 5*b* of the second idler gear 5. The gear 6 directly meshes with the large diameter toothed wheel 4*b* of the first idler gear 4 when the axle 4*c* of the idler gear 4 is urged to the upper end of the elongated hole 1*a* formed in the frame 1. A flywheel 7 is secured on the axle 6*a*.

Explanation is next made of the gear changing mechanism in accordance with the present invention. A gear changing lever 11 is pivotally mounted to the frame 1 by a pin 11*a*. The gear lever 11 has a stopper portion 11*c* formed in its lower end with a groove 11*c'*, and an operating portion 11*d*. A spring member 11*b* biases the lever 11 in the direction indicated by the arrow a to place the stopper portion 11*c* in the position of holding the axle 4*c* of the first idler gear 4 in the lower end of the elongated hole 1*a*. Depressing of the operating portion 11*d* causes the lever 11 to rotate against the force of the spring member 11*b* in the direction opposite to the arrow a direction, whereby the groove 11*c'* is disengaged from the axle 4*c*. A spring member 12 biases the axle 4*c* of the idler gear 4 toward the upper end of the elongated hole 1*a*.

The operation of the gear changing mechanism of the present invention will now be described. When the wheels 9 are rotated in the direction of the arrow b such as by rubbing them against the floor, the axle 4*c* of the first idler gear 4 is urged against the lower end of the elongated hole 1*a* and locked there by the stopper portion 11*c* with its groove 11*c* fitting on the axle 4*c*. The rotation of the wheels 9 is transmitted through the second idler gear 5 and the gears $6_1$ and $6_2$ to the gear 6 so as to rotate the flywheel 7 at a high speed. Thereafter, the axle 5*c* of the idler gear 5 falls down by its weight on the lower end of the elongated holes 1*b* so that the connection between the gear 5 and the gear $6_1$ is released. After the rotation of the wheels 9 stops, the operating portion 11*d* is depressed to rotate the gear changing lever 11 in the direction opposite to the arrow a direction and against the force of the spring member 11*b*, whereby the groove 11*c'* comes out of engagement from the axle 4*c*. The axle 4*c* is pushed against the upper end of the elongated holes 1*a* by the force of the spring member 12. The gear 6 meshes with the idler gear 4 so that rotation of the flywheel is transmitted to the wheels 9 thereby driving them at a high speed.

As described above, the present invention provides a gear changing mechanism for use in a built-in flywheel driving device. The mechanism comprises a gear changing lever 11 pivotally mounted to a frame 1 by means of a pin 11*a* and biased in one direction by means of a first spring member 11*b* to hold the axle 4*c* of an idler gear 4 in engagement with one end of an elongated hole 1*a* formed in the frame 1. The gear changing lever 11 is adapted to rotate by a depressing action against the force of the first spring member 11*b* to disengage the idler gear axle 4*c* from the one end of the elongated hole 1*a* so as to allow a second spring member 12 to urge the idler gear axle 4*c* against the other end of the elongated hole 1*a*. In this arrangement, the toy vehicle can be started or speed-changed by depressing of the operating portion of the gear changing lever to change the gear. That is, depressing of the operating portion of the gear changing lever will cause the wheels held stopped to start rotating (in case the idler gear 5 is used as described in the illustrated embodiment), or the wheels rotating at a low speed to rotate at a high speed (in case a normal gear is used in place of the idler gear 5).

What is claimed is:

1. A toy vehicle power source including a flywheel secured on an axle; gear means interconnecting said flywheel to toy vehicle wheels, said gear means including a first gear path to interconnect said flywheel to wheels at one gear ratio when said vehicle is moved in one direction and a second gear path when said flywheel drives said wheels; and shifting means for changing said gear means from one path to the other path, said shifting means including an idler gear, said idler gear being shiftable from a position of non-engagement to a position of engagement in said first gear path, said idler gear being shiftable from a position of engagement in said first gear path to a position of non-engagement, said idler gear being shiftable from said position of non-engagement to a position of engagement in said second gear path and said idler gear being shiftable from a position of engagement in said second gear path to a position of non-engagement, said shifting means further including a second idler gear, said second idler gear being engagable in said first gear path by the lifting action of said first-mentioned idler gear when said first idler gear is being driven.

2. The toy vehicle power source of claim 1 wherein said shifting means comprise a gear changing lever.

3. The toy vehicle power source of claim 1 wherein said second idler is disengaged by gravity whenever said first idler gear is not being driven.

4. The toy vehicle power source of claim 3 wherein said shifting means include a gear changing lever, said lever shifts said first idler gear from said non-engaged position to engagement in said second gear path thereby being adapted to drive wheels of a toy vehicle.

5. A toy vehicle comprising a vehicle body supported on a plurality of wheels, said body including a power source for driving certain of said wheels, said power source including a flywheel and gear means, said gear means including a first gear path and a second gear path, said first gear path providing a driving relationship between said wheels and said flywheel in one mode of operation and said second gear path being capable of providing a driving relationship between said flywheel and said wheels in another mode of operation;

said gear means including:

a first gear and axle combination, said axle being rotatably locked with respect to said driven wheels;

a second gear and axle combination, said axle being rotatably supported in a pair of arcuate slots, said second gear and axle combination being movable in said slots from a first operating position for function in said one mode of operation to a second operating position for function in said other mode of operation;

shifting means for moving said second gear and axle combination from said first operating position to said second operating position and from said second operating position to said first operating position; and a third gear and axle combination, said third gear and axle combination being rotatably supported in a pair of arcuate slots, said third gear and axle combination being movable in said slots from a first neutral position to a second operative position, wherein said third gear while in the first position engages only said first gear thereby providing said gear means with a neutral position in said one mode of operation and wherein said third gear in the second position provides a driving relationship between said wheels and said flywheel whereby said wheels may rotatably drive said flywheel, said third gear and axle combination being lifted into said second operative position by the increasing rotational force of said second gear and axle combination and falling by gravitational force into the neutral position when said second gear and axle combination is not imparting increasing rotational force.

6. The vehicle of claim 5 wherein said shifting means comprise spring means for urging said second gear and axle combination from said first operating position to said second operating position, said shifting means further including a shifting lever for holding said second gear and axle combination in said first position until said second gear and axle combination is released by manual movement of said shifting lever.

7. The vehicle of claim 6 wherein said shifting lever includes a groove in which said second axle lies when held in said first position.

8. The vehicle of claim 7 wherein shifting lever includes spring means for urging said shifting lever into the position of holding said second gear and axle combination in said first position when said flywheel is not driving said wheels.

* * * * *